US007483048B2

(12) United States Patent
Jung et al.

(10) Patent No.: US 7,483,048 B2
(45) Date of Patent: Jan. 27, 2009

(54) APPARATUS FOR FIXING SHAFT OF CARTRIDGE AND IMAGE FORMING DEVICE HAVING THE SAME

(75) Inventors: Woo-chul Jung, Yongin-si (KR); Se-hyun Lyu, Seoul (KR); Heung-sup Jeong, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 181 days.

(21) Appl. No.: 11/180,585

(22) Filed: Jul. 14, 2005

(65) Prior Publication Data

US 2006/0165427 A1 Jul. 27, 2006

(30) Foreign Application Priority Data

Jan. 21, 2005 (KR) ..... 10-2005-0005897

(51) Int. Cl.
*B41J 29/00* (2006.01)
*G03G 21/16* (2006.01)
*G03G 21/18* (2006.01)

(52) U.S. Cl. ..... 347/263; 347/245; 399/111

(58) Field of Classification Search ..... 347/224–264; 399/110–111, 114, 116–117
See application file for complete search history.

(56) References Cited

U.S. PATENT DOCUMENTS 4,183,658 A * 1/1980 Winthaegen ..... 399/165
6,144,398 A * 11/2000 Yokoyama et al. ..... 347/263
6,240,266 B1 * 5/2001 Watanabe et al. ..... 399/117
2002/0018666 A1 * 2/2002 Noda et al. ..... 399/90
2004/0179859 A1 * 9/2004 Ishii ..... 399/119

FOREIGN PATENT DOCUMENTS

JP 2000-242059 9/2000
JP 2002-099129 4/2002
JP 2002099129 A * 4/2002
JP 2004-163579 6/2004
KR 1020000039198 7/2000

OTHER PUBLICATIONS

Wikipedia, CAM, http://en.wikipedia.org/wiki/cam.*

* cited by examiner

*Primary Examiner*—Huan H Tran
(74) *Attorney, Agent, or Firm*—Roylance, Abrams, Berdo & Goodman, L.L.P.

(57) ABSTRACT

An apparatus is provided for fixing a shaft of a cartridge and an image forming device including the apparatus. The apparatus includes a fixed supporting part formed at a frame, and rotatably supporting a first end of at least one shaft of at least one cartridge. A movable supporting part is formed at the frame to be movable between a first position and a second position, and rotatably supporting a second end of the shaft of the cartridge. An operating part operates to move the movable supporting part between the first position and the second position. The fixed supporting part and the movable supporting part fix the shaft of the cartridge, and the movable supporting part works together with opening and closing operation of the cover. The shaft of the cartridge is fixed in the proper position, but also a corresponding cartridge, such as an image forming cartridges, is easily assembled and disassembled in the frame of the main body when the cartridge is mounted in the frame.

20 Claims, 7 Drawing Sheets

APPARATUS FOR FIXING SHAFT OF CARTRIDGE AND IMAGE FORMING DEVICE HAVING THE SAME

CROSS-REFERENCE TO RELATED APPLICATIONS

This application claims the benefit under 35 U.S.C. § 119(a) of Korean Patent Application No. 2005-5897, filed on Jan. 21, 2005, in the Korean Intellectual Property Office, the entire disclosure of which is hereby incorporated by reference.

BACKGROUND OF THE INVENTION

1. Field of the Invention

The present invention relates to an electrophotographic image forming device, such as a printer or a copier. More particularly, the present invention relates to a tandem color image forming device having a plurality of photosensitive bodies disposed in parallel.

2. Description of the Related Art

Generally, an electrophotographic tandem color image forming device is provided with a plurality of image forming units disposed in parallel. A plurality of photosensitive bodies form toner images representing yellow, magenta, cyan and black colors, respectively, by the corresponding image forming units. A transfer unit transfers the toner images formed on the photosensitive bodies onto a recording medium, such as a sheet of printing paper. A fusing unit fuses and fixes the toner images transferred onto the recording medium with heat and pressure.

Another tandem color image forming device further includes an intermediate transfer unit, such as a transfer belt or a transfer drum, disposed between the photosensitive bodies and the transfer unit. The toner images formed on the photosensitive bodies are not directly transferred to the recording medium, but are first transferred as a first transfer image onto the intermediate transfer unit and then retransferred from the intermediate transfer unit onto the recording medium.

These tandem color image forming devices having a plurality of photosensitive bodies that form a required image by simultaneously revolving the plurality of photosensitive bodies have an advantage that a required color image is obtained quickly. Comparatively, a color image forming device having a single photosensitive body therein forms a required image by revolving the single photosensitive body several times. However, since use of the plurality of photosensitive bodies and the image forming units has a complicated construction, it requires that the tandem color image forming device should be constructed to be easily assembled, maintained and repaired.

Accordingly, the tandem color image forming device generally does not configure the photosensitive bodies and the image forming units to be separated from one another, but to be contained in a plurality of image forming cartridges, each in which a photosensitive body and an image forming unit are modularized in a body, so that they may be mounted in or removed from main body as a single part as a cartridge unit.

Since the image forming cartridges are removably mounted in the main body, they provide an advantage that the parts therein may be easily maintained or repaired. However, because the photosensitive bodies in the respective image forming cartridges transfer corresponding color images onto the same image forming position of the recording medium or the intermediate transfer unit, color deviation may occur between the respective transferred color images if the photosensitive bodies are not arranged in parallel to one another when mounted in the main body.

To solve the problem, a conventional tandem color image forming device includes a shaft fixing apparatus 1 for fixing shafts of photosensitive bodies in image forming cartridges in the right position, as shown in FIG. 1.

The shaft fixing apparatus 1 includes first and second fixing parts 11 and 15.

The first fixing part 11 has a plurality of rotation supporting holes 13 to rotatably support first ends 22 of shafts 8 of photosensitive bodies 7 in a plurality of image forming cartridges 2.

The rotation supporting holes 13 are formed in a spaced-apart relation from one another at a cartridge frame 10 of the main body corresponding to the first ends 22 of the shafts 8 of the photosensitive bodies 7. Accordingly, the rotation supporting holes 13 receive and rotatably support the first ends 22 of the shafts 8 when the respective image forming cartridges 2 are mounted in the cartridge frame 10.

The second fixing part 15 has a plurality of rotating members 16 to rotatably support second ends 17 of the shafts 8 of the photosensitive bodies 7 in the image forming cartridges 2.

Each rotating member 16 is provided with a coupling axle 18, a support axle 33, and a driven gear 34. As shown in FIG. 3B, the coupling axle 18 has a triangle-shaped recess 18*a* formed at an end thereof. As shown in FIG. 3A, the recess 18*a* receives a triangle-shaped projection 17*a* formed on the second end 17 of the shaft 8 of each photosensitive body 7 when each image forming cartridge 2 is mounted in the cartridge frame 10. The support axle 33 is installed to be movable in a direction of arrows A and B in a support hole 10*a* formed in a spaced-apart relation from one another at the cartridge frame 10, and pressed in the direction of arrow B, that is, toward the second end 17 of the shaft 8, by a compression spring 21. The driven gear 34 is positioned between the support axle 33 and the coupling axle 18, and engaged with a gear train 19 for transmitting a driving force from a motor 30.

The gear train 19 includes a plurality of power transmitting gears 23 connected with a driving gear 20 formed on a driving axle 30*a* of the motor 30, and transmits the driving force of the motor to the driven gear 34 of each rotating member 16.

Operations of assembling and disassembling the image forming cartridges 2 of the conventional image forming device having the shaft fixing apparatus 1 constructed as described above is as follows.

Since the installation operation of all image forming cartridges 2 is the same, only the image forming cartridge 2, which is located at the lowest position, is explained.

First, the image forming cartridge 2 is inserted in the cartridge frame 10 of the main body, and placed on a supporting plate 36 of the cartridge frame 10.

Subsequently, the first end 22 of the shaft 8 of the photosensitive body 7 is arranged in line with the corresponding rotation supporting hole 13 by adjusting the position of the image forming cartridge 2, and is then inserted in the corresponding rotation supporting hole 13.

Then, as shown in FIG. 2, the rotating member 16 is pushed in the direction of arrow A against the elastic force of the compression spring 21, and moved toward the cartridge frame 10.

In this position, after the second end 17 of the shaft 8 is arranged in line with the coupling axle 18, the force of pushing the rotating member 16 in the direction of arrow A is released. Accordingly, the rotating member 16 moves in the direction of arrow B by the elastic force of the compression spring 21. As a result, as shown in FIG. 1, the end of the coupling axle 18 is maintained in contact with the second end 17 of the shaft 8. At this time, the projection 17*a* of the second end 17 is positioned in a coupled state that is inserted in the recess 18*a* of the coupling axle 18 or an uncoupled state that is not inserted in the recess 18*a* depending on the phase thereof.

When the motor 30 is driven to carry out the image forming operation, the driving gear 20 fixed on the driving axle 30*a* of the motor 30 drives the driven gear 34 of the rotating member 16 through the power transmitting gears 23 of the gear train 19. As a result, the coupling axle 18 of the rotating member 16 rotates in the corresponding direction.

As the coupling axle 18 rotates, the recess 18*a* of the coupling axle 18 rotates with respect to the projection 17*a*. At this time, in case that the recess 18*a* is in the uncoupled state with the projection 17*a*, when the recess 18*a* is in phase with the projection 17*a*, it is coupled with the projection 17*a*.

As a result, the rotation force of the rotating member 16 is transmitted to the photosensitive body 7, and the rotation force transmitted to the photosensitive body 7 is again transmitted to other parts, such as a developing roller and the like, in the image forming cartridge 2 by a power transmitting mechanism (not shown), thereby the image forming operation being carried out.

However, according to the conventional shaft fixing apparatus 1 operated as above, to couple the second end 17 of the shaft 8 of the photosensitive body 7 to the rotating member 16 users have to arrange the second end 17 in line with the coupling axle 18 by adjusting the position or direction of the image forming cartridge 2 while pushing the rotating member 16 in the direction of arrow A. Since the arranging operation is carried out at a narrow space in the cartridge frame 10 of the main body, it is difficult and troublesome, and a large amount of assembling time is required, thereby productivity and assembling efficiency are deteriorated.

Further, the conventional shaft fixing apparatus 1 has the triangle-shaped projection 17*a* and the triangle-shaped recess 18*a* formed respectively on the second end 17 of the shaft 8 and the coupling axle 18 to serve as a coupling device for transmitting the driving force of the motor 30 to the shaft 8 of the photosensitive body 7.

Since with such a triangle-shaped construction, the projection 17*a* and the recess 18*a* require complicated machining in fabrication, they cause not only fabrication thereof to be difficult, but also increase fabrication costs.

Also, after fabrication or assembling, if the projection 17*a* is positioned in the uncoupled state that is not inserted in the recess 18*a* due to a difference in phase therebetween, it is apt not to slide into the recess 18*a*, but to idle by the rotating force of the coupling axle 18 in operation, thereby generating poor coupling.

Thus, if the projection 17*a* is not stably coupled with the recess 18*a*, the driving force of the motor 30 may not be transmitted well to the parts, such as the photosensitive body 7 and the developing roller contained in the image forming cartridge 2. As a result, the quality in the resultant image formed by the image forming cartridge 2 may be deteriorated.

Accordingly, a need exists for an image forming apparatus having an improved tandem color image forming device including a plurality of photosensitive bodies disposed in parallel that is easily inserted in and removed from the image forming apparatus, and providing uniform quality images.

SUMMARY OF THE INVENTION

An aspect of the present invention is to provide an apparatus for fixing a shaft of a cartridge having an improved structure. When at least one cartridge, such as an image forming cartridge to modularize a plurality of parts in a body, is mounted in a frame of a main body, a shaft of the cartridge, such as a shaft of the photosensitive body, may be fixed in a proper position. An image forming device is provided having the same.

Another aspect of the present invention is to provide an apparatus for fixing a shaft of a cartridge having an improved structure that when at least one cartridge, such as an image forming cartridge to modularize a plurality of parts in a body, is mounted in or removed from a frame of main body, it may be easily assembled and disassembled. An image forming device is provided having the same.

An apparatus for fixing a shaft of a cartridge includes a fixed supporting part formed at a frame, and rotatably supporting a first end of at least one shaft of at least one cartridge. A movable supporting part is formed at the frame to be movable between a first position and a second position, and rotatably supporting a second end of the shaft of the cartridge. An operating part operates to move the movable supporting part between the first position and the second position.

The fixed supporting part may include at least one fixed bracket having a first rotation supporting hole to rotatably support the first end of the shaft of the cartridge. The fixed bracket may further include a first stopper for restraining movement of the first end of the shaft of the cartridge to guide a fixing position of the first end.

The movable supporting part may include at least one movable bracket having a second rotation supporting hole to rotatably support the second end of the shaft of the cartridge. A bracket moving guide guides the movable bracket to be movable between the first position and the second position. The movable bracket may further include a second stopper for restraining movement of the second end of the shaft of the cartridge to guide a fixing position of the second end.

The operating part may include a cam member having a cam disposed to be in contact with the movable bracket. A cam gear is formed on a shaft of the cam. A rotation actuator rotates the cam gear. At this time, it is preferable that the rotation actuator includes a projecting member having a plurality of projections formed in a spaced-apart relation from each other at an outer circumference of the cam gear. A link member is connected to a cover for opening the inside of the frame to move together with the cover. A plurality of receiving grooves are formed in the same spaced-apart relation from each other as the projections of the projecting member to be engaged therewith in opening and closing of the cover.

The operating part may further include a pulling member for elastically pulling the movable bracket to be in contact with the cam. The pulling member may include an elastic spring disposed between the movable bracket and the bracket moving guide.

In a preferred embodiment, the shaft of the cartridge is a shaft of a photosensitive body on which a developer images is formed.

According to another exemplary embodiment, an image forming device includes a frame, and at least one cartridge removably mounted in the frame, having at least one shaft. A shaft fixing unit fixes the shaft of the cartridge. A fixed supporting part is formed at the frame, and rotatably supports a first end of the shaft of the cartridge. A movable supporting part formed at the frame is movable between a first position and a second position, and rotatably supports a second end of the shaft of the cartridge. An operating part operates to move the movable supporting part between the first position and the second position.

The fixed supporting part may include at least one fixed bracket having a first rotation supporting hole to rotatably support the first end of the shaft of the cartridge. The fixed bracket may further include a first stopper for restraining movement of the first end of the shaft of the cartridge to guide a fixing position of the first end.

The movable supporting part may include at least one movable bracket having a second rotation supporting hole to rotatably support the second end of the shaft of the cartridge. A bracket moving guide guides the movable bracket to be movable between the first position and the second position. The movable bracket may further include a second stopper for restraining movement of the second end of the shaft of the cartridge to guide a fixing position of the second end.

The operating part may include a cam member having a cam disposed to be in contact with the movable bracket, a cam gear formed on a shaft of the cam, and a rotation actuator to rotate the cam gear. Preferably, the rotation actuator is composed of a projecting member having a plurality of projections formed in a spaced-apart relation from each other at an outer circumference of the cam gear, and a link member connected to a cover for opening the inside of the frame to move together with the cover. A plurality of receiving grooves are formed in the same spaced-apart relation from each other as the projections of the projecting member to be engaged therewith in opening and closing of the cover.

The operating part may further include a pulling member for elastically pulling the movable bracket to be in contact with the cam. The pulling member may be composed of an elastic spring disposed between the movable bracket and the bracket moving guide.

In a preferred embodiment, the shaft of the cartridge is a shaft of a photosensitive body on which a developer image is formed.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above aspects, features and advantages of the present invention will become more apparent from the following detailed description when taken in conjunction with the accompanying drawings, in which.

Throughout the drawings, like reference numerals will be understood to refer to like parts, components and structures.

DETAILED DESCRIPTION OF EXEMPLARY EMBODIMENTS

An apparatus for fixing a shaft of a cartridge and an image forming device having the same according to an exemplary embodiment of the present invention is described below with reference to the accompanying drawings.

Figure 4:
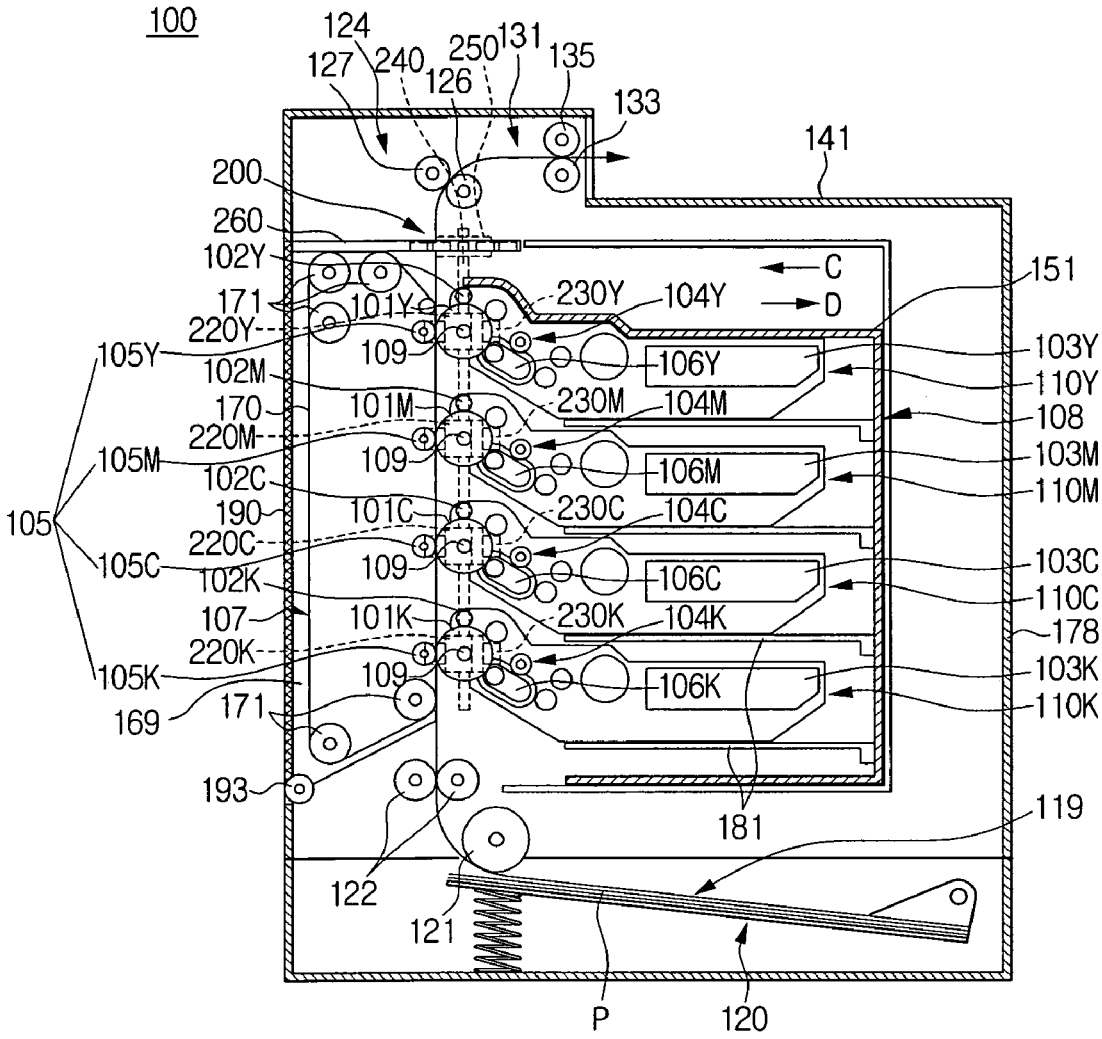
FIG. 4 is a schematic side elevational view of a tandem color image forming device in which an apparatus for fixing a shaft of a cartridge according to an exemplary embodiment of the present invention is applied.

FIG. 4 schematically shows a tandem color image forming device 100 in which an apparatus for fixing a shaft of a cartridge according to a first exemplary embodiment of the present invention is applied.

The tandem color image forming device 100 includes a paper feeding unit 119, a cartridge frame 108, a shaft fixing unit 200, a shaft driving unit 149 (see FIG. 6), a transfer unit 107, a fusing unit 124, and a paper-discharging unit 131.

The paper feeding unit 119, which feeds a sheet of printing paper P, has a paper cassette 120, a pickup roller 121, and feeding and backup rollers 122. The description about the paper cassette 120, the pickup roller 121, and the feeding and backup rollers 122 is omitted here, as it is identical to that of the conventional ones known in the art.

The cartridge frame 108 is disposed over the paper feeding unit 119, and fixes first, second, third, and fourth image forming cartridges 110Y, 110M, 110C and 110K.

The cartridge frame 108 is provided with a substantially rectangle-shaped case 151 having four supporting plates 181 formed in a longitudinally spaced-apart relation from one another. The first, the second, the third, and the fourth image forming cartridges 110Y, 110M, 110C and 110K are supported in parallel on the supporting plates 181.

The first, the second, the third, and the fourth image forming cartridges 110Y, 110M, 110C and 110K form toner images of predetermined colors, for example, yellow (Y), magenta (M), cyan (C), and black (K), respectively. The first, the second, the third, and the fourth image forming cartridges 110Y, 110M, 110C and 110K are modular to include: first, second, third, and fourth photosensitive bodies 101Y, 101M, 101C and 101K, each of which is formed of an organic photosensitive drum; first, second, third, and fourth electrification parts 102Y, 102M, 102C and 102K; first, second, third, and fourth cleaning parts 106Y, 106M, 106C and 106K; first, second, third, and fourth laser scanning parts 103Y, 103M, 103C and 103K; and first, second, third, and fourth developing parts 104Y, 104M, 104C and 104K.

The first, the second, the third, and the fourth laser scanning units 103Y, 103M, 103C and 103K are exemplified as respectively modularized in the first, the second, the third, and the fourth image forming cartridges 110Y, 110M, 110C and 110K, but they may be constructed in such a manner that they are installed in the case 151 of the cartridge frame 108 apart from the first, the second, the third, and the fourth image forming cartridges 110Y, 110M, 110C and 110K.

Figure 6:
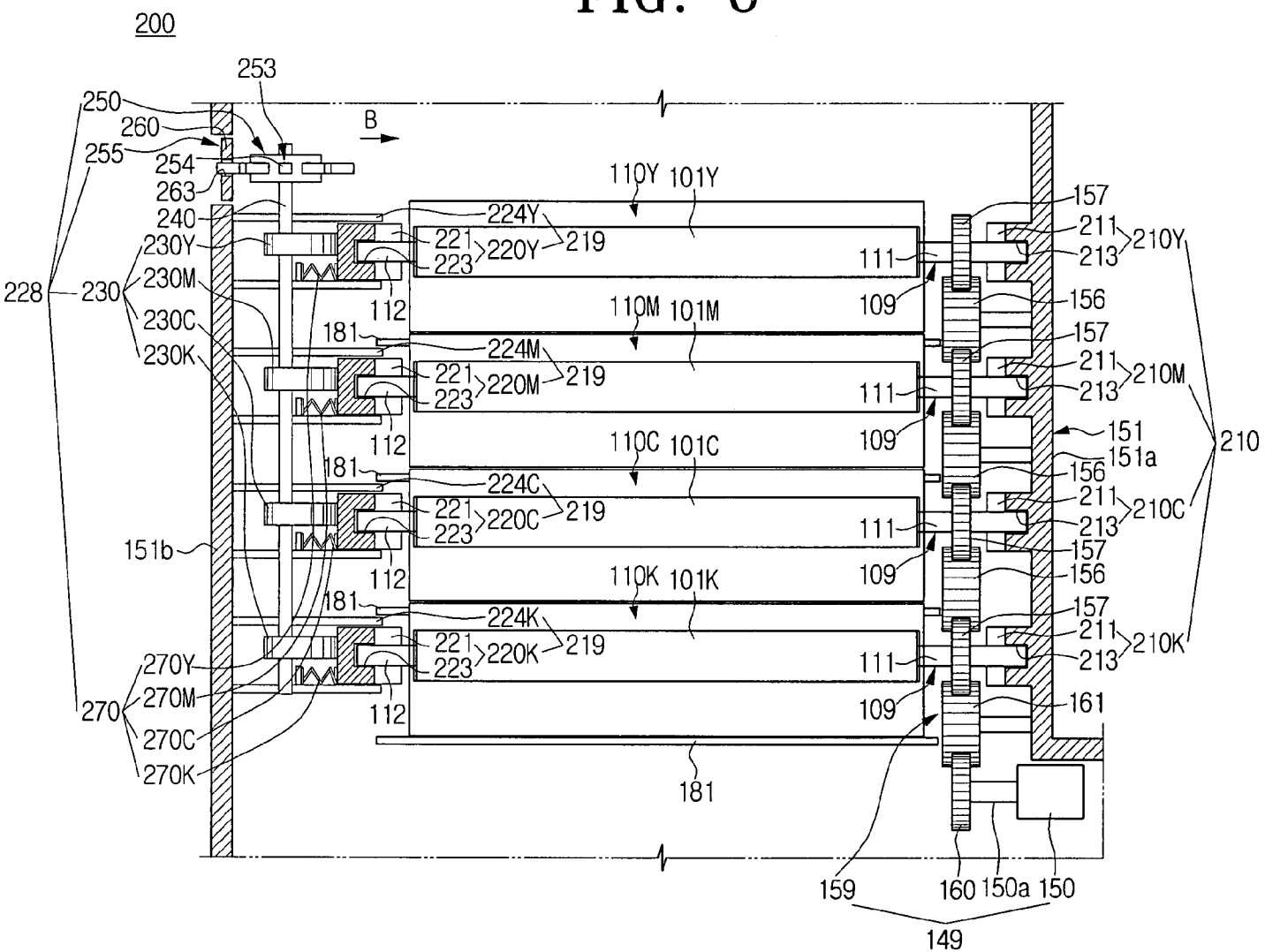
FIG. 6 is a partial front elevational view exemplifying the shaft fixing apparatus of the image forming device shown in FIG. 4.

The shaft fixing unit 200 includes a fixed supporting part 210, a movable supporting part 219, and an operating part 228, as shown in details in FIG. 6, and fixes shafts 109 of the first, the second, third, and the fourth photosensitive bodies 101Y, 101M, 101C and 101K, which are modularized in the first, the second, the third, and the fourth image forming cartridges 110Y, 110M, 110C and 110K, in a proper position according to an exemplary embodiment of the present invention.

The fixed supporting part 210 includes first, second, third, and fourth fixed brackets 210Y, 210M, 210C and 210K and rotatably supports first ends 111 of the shafts 109 of the first, the second, third, and the fourth photosensitive bodies 101Y, 101M, 101C and 101K.

The first, the second, the third, and the fourth fixed brackets 210Y, 210M, 210C and 210K are formed in a spaced-apart relation from one another corresponding to the first ends 111 of the shafts 109 of the first, the second, third, and the fourth photosensitive bodies 101Y, 101M, 101C and 101K on a first side wall 151*a* of the case 151 of the cartridge frame 108. The first, the second, the third, and the fourth fixed brackets 210Y, 210M, 210C and 210K are respectively provided with first rotation supporting holes 213 and first stoppers 211.

The first rotation supporting holes 213 rotatably support the first ends 111 of the shafts 109 of the photosensitive bodies 101Y, 101M, 101C and 101K, respectively.

The first stoppers 211 restrain the first ends 111 of the shafts 109 from moving beyond a predetermined limit when the first, the second, the third, and the fourth image forming cartridges 110Y, 110M, 110C and 110K are inserted in a rear direction (direction of arrow D in FIGS. 4 and 5) and disposed on the supporting plates 181 of the case 151, thereby assisting the first ends 111 of the shafts 109 to be positioned in the proper position.

The movable supporting part 219 includes first, second, third, and fourth movable brackets 220Y, 220M, 220C and 220K, and first, second, third, and fourth bracket moving guides 224Y, 224M, 224C and 224K, and rotatably supports second ends 112 of the shafts 109 of the first, the second, third, and the fourth photosensitive bodies 101Y, 101M, 101C and 101K.

The first, the second, the third, and the fourth movable brackets 220Y, 220M, 220C and 220K are formed in a spaced-apart relation from one another corresponding to the second ends 112 of the shafts 109 of the first, the second, third, and the fourth photosensitive bodies 101Y, 101M, 101C and 101K on a second side wall 151*b* of the case 151 of the cartridge frame 108. The first, the second, the third, and the fourth movable brackets 220Y, 220M, 220C and 220K are respectively provided with second rotation supporting holes 223 and second stoppers 221.

The second rotation supporting holes 223 rotatably support the second ends 112 of the shafts 109 of the photosensitive bodies 101Y, 101M, 101C and 101K.

The second stoppers 221 restrain the second ends 112 of the shafts 109 from moving beyond a predetermined limit when the first, the second, the third, and the fourth image forming cartridges 110Y, 110M, 110C and 110K are inserted in the rear direction (the direction of arrow D in FIGS. 4 and 5) and disposed on the supporting plates 181 of the case 151, thereby assisting the second ends 112 of the shafts 109 to be positioned in the proper position.

Figure 7:
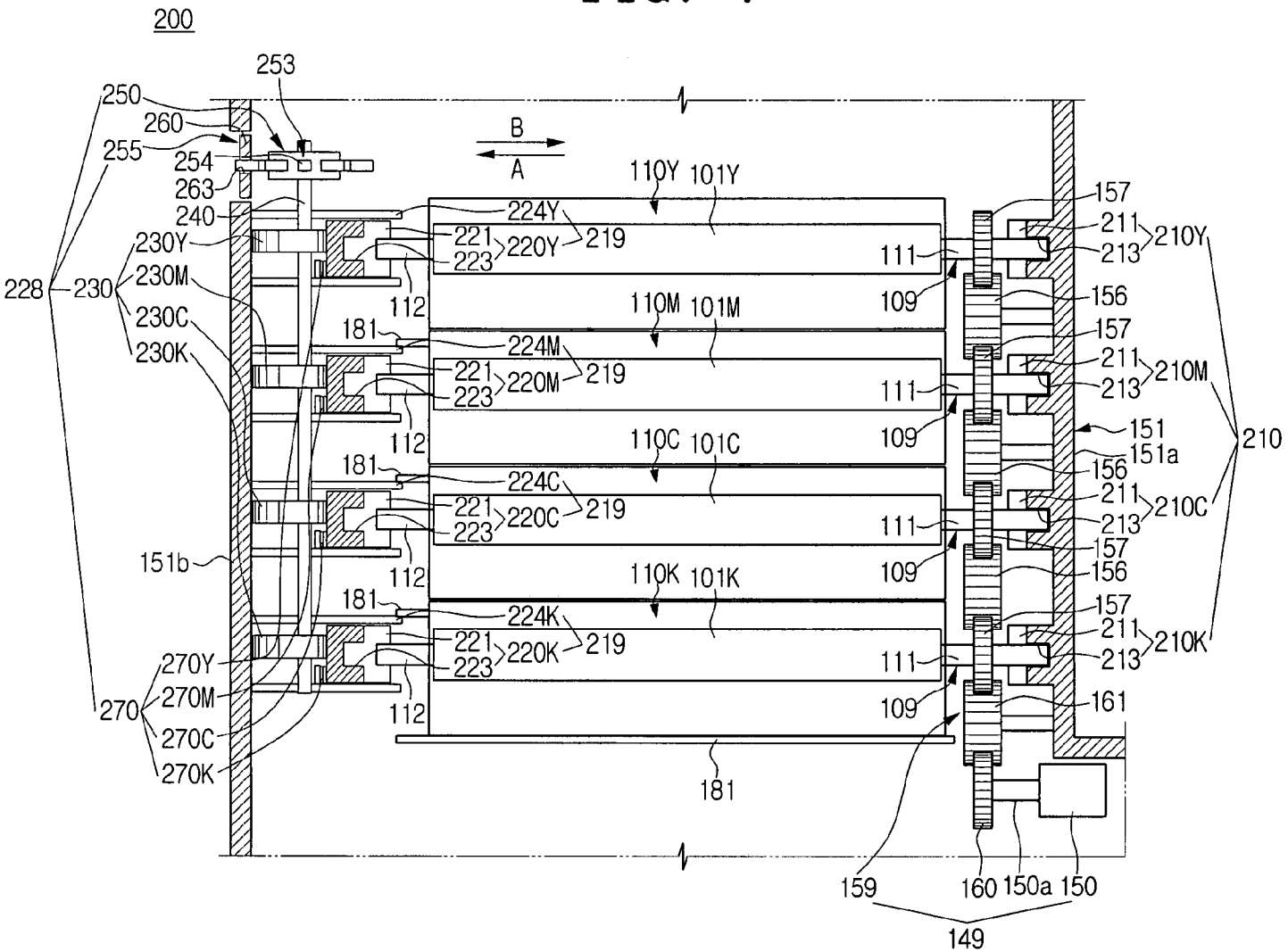
FIG. 7 is a partial front elevational view exemplifying operation of the shaft fixing apparatus of the image forming device shown in FIG. 4.

The first, the second, the third, and the fourth bracket moving guides 224Y, 224M, 224C and 224K are formed on the second side wall 151*b* of the case 151 to guide the first, the second, the third, and the fourth movable brackets 220Y, 220M, 220C and 220K to be movable between a first position (FIG. 6) and a second position (FIG. 7). The first position is a position where the second ends 112 of the shafts 109 are inserted and supported in the second rotation supporting holes 223. The second position is a position where the second ends 112 of the shafts 109 are separated from the second rotation supporting holes 223. Accordingly, different from the first, the second, the third, and the fourth fixed brackets 210Y, 210M, 210C and 210K, the first, the second, the third, and the fourth movable brackets 220Y, 220M, 220C and 220K are movable in an axial direction (directions of arrows A and B in FIG. 7) between the first and second positions.

The operating part 228 includes a cam member 230, a cam gear 250, a rotation actuator 255, and a pulling member 270 to operate the first, the second, the third, and the fourth movable brackets 220Y, 220M, 220C and 220K of the movable supporting part 219 between the first and second positions.

The cam member 230 includes first, second, third, and fourth cams 230Y, 230M, 230C and 230K formed spaced-apart from one another on a cam shaft 240 to be in contact with the first, the second, the third, and the fourth movable brackets 220Y, 220M, 220C and 220K.

The cam gear 250 is formed on an upper portion of the camshaft 240, and linked with a link member 260 that is described below.

Figure 5:
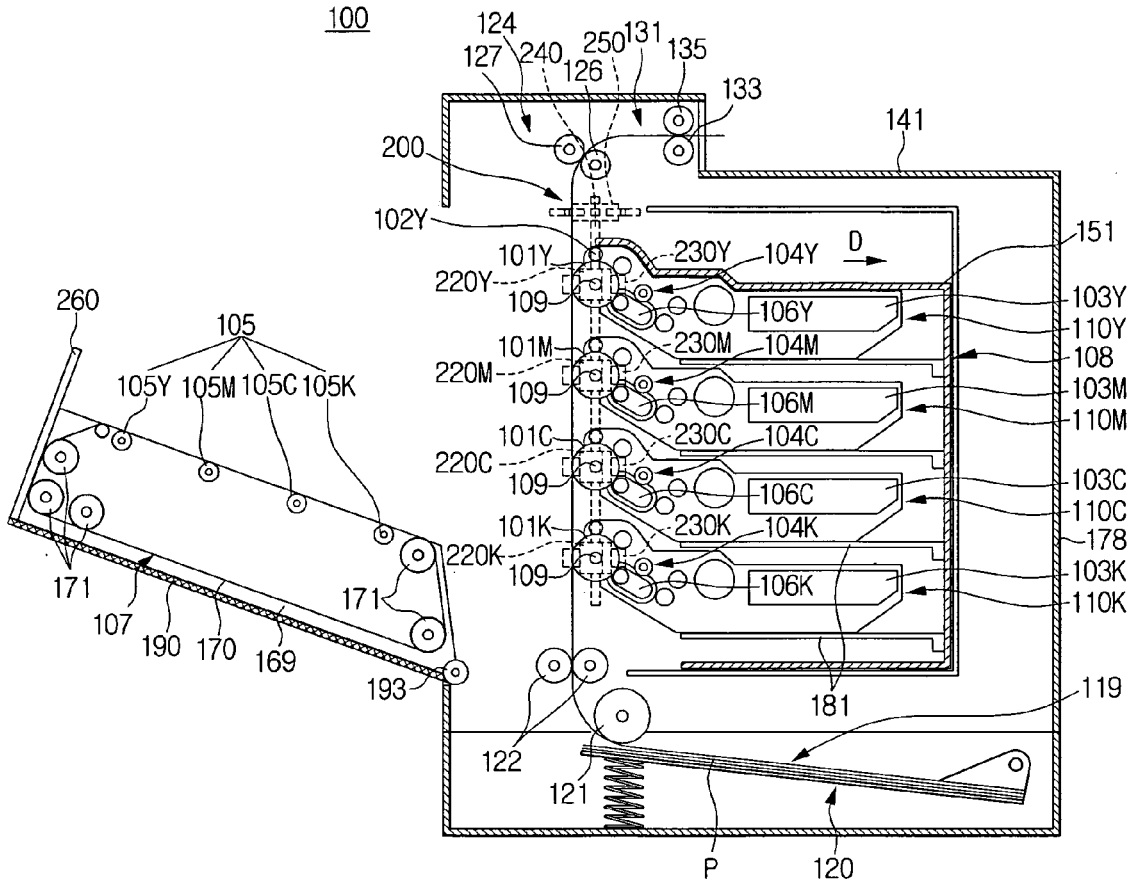
FIG. 5 is a schematic side elevational view exemplifying the image forming device shown in FIG. 4 when a cover is opened.
Figure 9A:
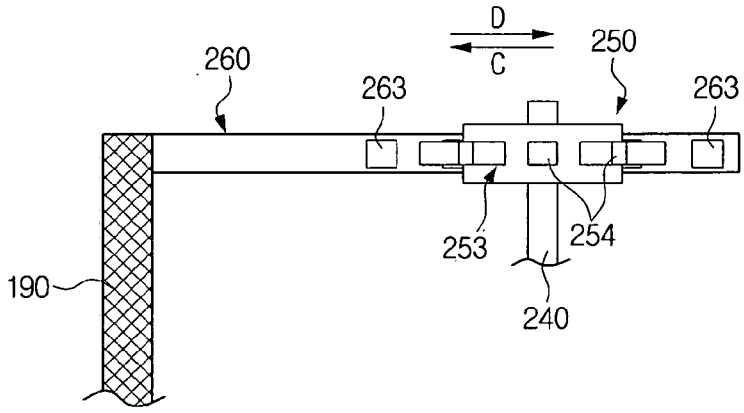
FIGS. 9A and 9B are a partial front elevational view and a top plan view exemplifying operation of a link member and a cam gear of the shaft fixing apparatus of the image forming device shown in FIG. 4.
Figure 9B:
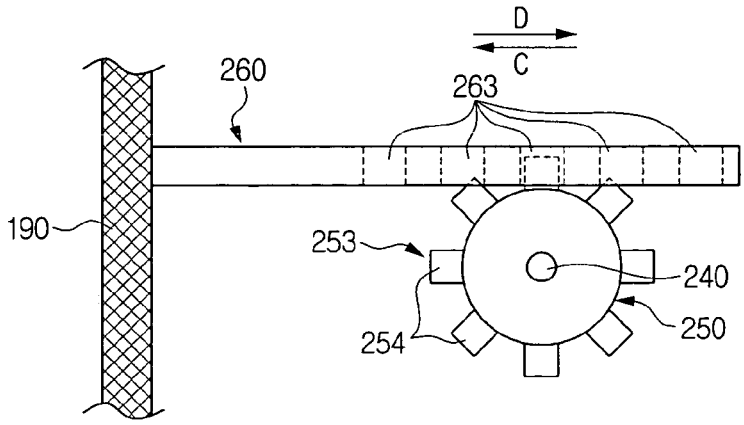

The rotation actuator 255, which rotates the cam gear 250, is provided with a projecting member 253 and a link member 260. As shown in FIGS. 9A and 9B, the projecting member 253 is composed of a plurality of projections 254 formed in a spaced-apart relation from one another at an outer circumference of the cam gear 250. The link member 260 is connected to a cover 190 for opening the inside of the case 151 of the cartridge frame 108 to move together with the cover 190, and has a plurality of receiving holes or grooves 263 formed in the same spaced-apart relation from one another as the projections 254 of the projecting member 253 to be engaged therewith in opening and closing of the cover 190. The cover 190 is pivotally supported on a rotation axle 193 formed at the main body 178, as shown in FIG. 5.

The rotation actuator 255 is exemplified as provided of the projecting member 253 and the link member 260, but it may be configured to have other constructions, for example, including a motor (not shown) having a driving gear (not shown) engaged with the cam gear 250 through a gear train (not shown), and a switch (not shown) to turn on or off the motor by opening and closing operation of the cover 190.

The pulling member 270 is composed of extension springs 270Y, 270M, 270C and 270K installed between the first, the second, the third, and the fourth movable brackets 220Y, 220M, 220C and 220K and the first, the second, the third, and the fourth bracket moving guides 224Y, 224M, 224C and 224K, and elastically pulls the first, the second, the third, and the fourth movable brackets 220Y, 220M, 220C and 220K to be in contact with the first, the second, the third, and the fourth cams 230Y, 230M, 230C and 230K.

Figure 1:
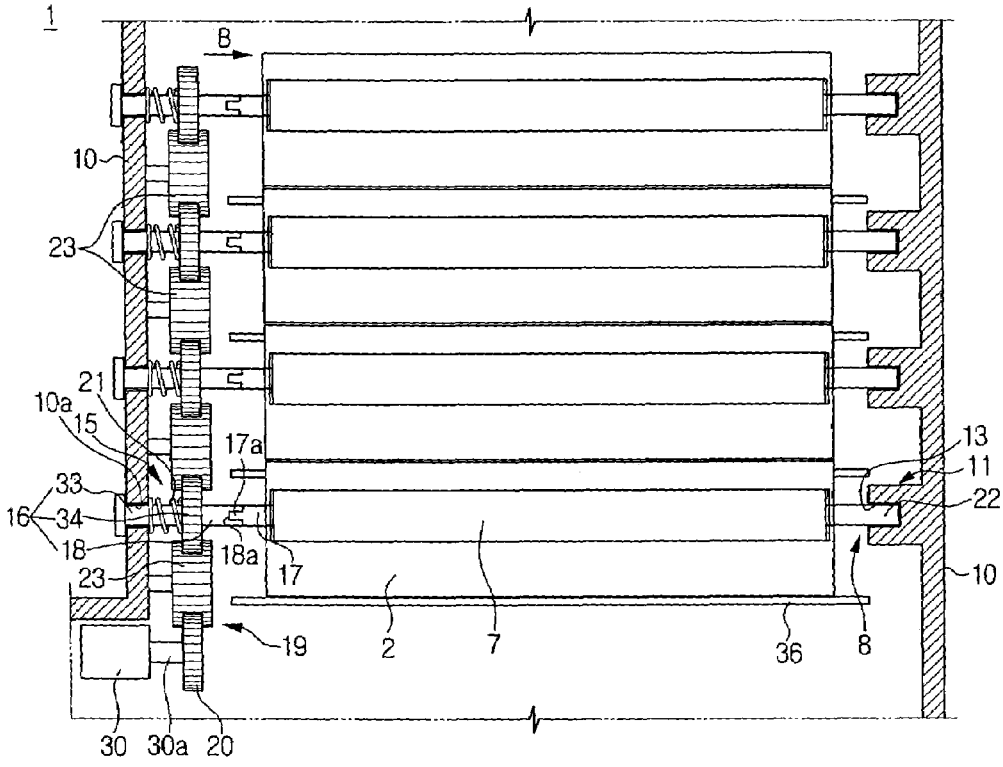
FIG. 1 (PRIOR ART)
FIG. 1 is a partial front elevational view of a conventional tandem color image forming device exemplifying an apparatus for fixing shaft of photosensitive body.
Figure 2:
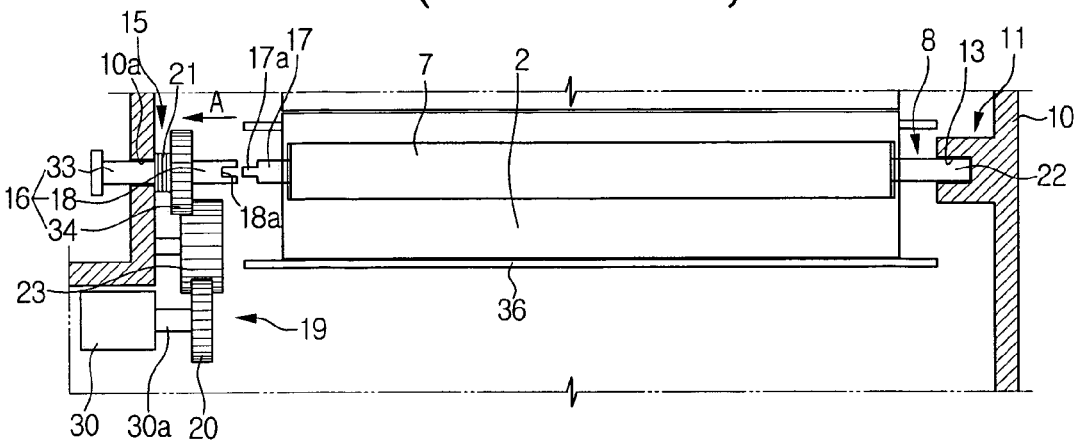
FIG. 2 (PRIOR ART)
FIG. 2 is a partial front elevational view exemplifying operation of the shaft fixing apparatus shown in FIG. 1.
Figure 3A:
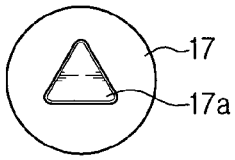
FIG. 3A (PRIOR ART)
FIGS. 3A and 3B are top plan views exemplifying a projection and a recess of the shaft fixing apparatus shown in FIG. 1.
Figure 3B:
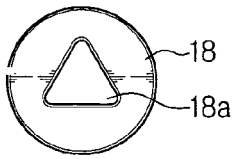
FIG. 3B (PRIOR ART)

Thus, the shaft fixing unit 200 of an exemplary embodiment of the present invention does not have a coupling structure of transmitting the driving force of the motor to the shafts as in the conventional shaft fixing apparatus 1 explained with reference to FIG. 1, but serves only to fix the shafts 109. Therefore, when the first, the second, the third, and the fourth image forming cartridges 110Y, 110M, 110C and 110K are mounted in the case 151 of the cartridge frame 108, the first, the second, the third, and the fourth photosensitive bodies 101Y, 101M, 101C and 101K may be fixed at the proper position. Thereby, the first, the second, the third, and the fourth image forming cartridges 110Y, 110M, 110C and 110K obtain uniform quality images.

The shaft fixing unit 200 has a structure of fixing the shafts 109 of the photosensitive bodies by using the movable supporting part 219, which is worked with opening and closing operation of the cover 190. Therefore, the first, the second, the third, and the fourth image forming cartridges 110Y, 110M, 110C and 110K may be easily assembled and disassembled in the case 151 of the cartridge frame 108.

The shaft driving unit 149, which transmits the driving force to the shafts 109 of the first, the second, the third, and the fourth photosensitive bodies 101Y, 101M, 101C and 101K, includes a motor 150 and a gear train 159.

The motor 150 is installed at a lower portion of the first sidewall 151*a* of the case 151 of the cartridge frame 108.

The gear train 159 includes a power transmitting gear 161 engaged with a driving gear 160 formed on a driving axle 150*a* of the motor 150, driven gears 157 formed on the first ends 111 of the shafts 101 of the first, the second, the third, and the fourth photosensitive bodies 101Y, 101M, 101C and 101K, and idle gears 156 having axles rotatably fixed on the first side wall 151*a* of the case of 151 of the cartridge frame 108 between the respective driven gears 157.

The transfer unit 107 is integrally formed with the cover 190 thereby to be opened and closed together with the cover 190, and transfers toner images formed on the first, the second, the third, and the fourth photosensitive bodies 101Y, 101M, 101C and 101K to a sheet of printing paper P.

The transfer unit 107 is provided with a paper transfer belt 170, and a transfer part 105. The paper transfer belt 170 is rotatably supported on a plurality of rollers 171 installed at a cover frame 169. The transfer part 105 includes first, second, third, and fourth transfer rollers 105Y, 105M, 105C and 105K installed inside of the paper transfer belt 170 at the cover frame 169 opposite to the first, the second, the third, and the fourth photosensitive bodies 101Y, 101M, 101C and 101K. The first, the second, the third, and the fourth transfer rollers 105Y, 105M, 105C and 105K are installed so that they are elastically pressed against the second, the third, and the fourth photosensitive bodies 101Y, 101M, 101C and 101K with predetermined pressure. A predetermined transfer voltage is applied to the first, the second, the third, and the fourth transfer rollers 105Y, 105M, 105C and 105K, so that the toner images formed on the first, the second, the third, and the fourth photosensitive bodies 101Y, 101M, 101C and 101K are transferred to the printing paper P.

The fusing unit 124, which fixes the toner images transferred to the printing paper P, includes a heating roller 126 and a compressing roller 127. The heating roller 126 has a heater (not shown) installed therein to fuse the toner images with a heat of high temperature and thereby to fix it on the printing paper P. The compressing roller 127 is pressed toward the heating roller 126 by an elastic pressing mechanism (not shown) to compress the printing paper P against the heating roller 126 with predetermined pressure.

The paper-discharging unit 131 includes a paper-discharge roller 133 and a paper-discharge backup roller 135, and discharges the printing paper P with the toner image fixed by the heating roller 126 and the compressing rollers 127 out of the printer.

Although it has been exemplified herein that the image forming device in which the shaft fixing unit 200 according to exemplary embodiments of the present invention is applied is composed of the tandem color image forming device 100 in which the toner images formed on the first, the second, the third, and the fourth photosensitive bodies 101Y, 101M, 101C and 101K are directly transferred to the printing paper P, this should not be considered as limiting. That is, the image forming device having the shaft fixing unit 200 according to exemplary embodiments of the present invention may be applied to other image forming devices, for example, an image forming device including an intermediate transfer unit, such as an image transfer belt, having the same principle and construction. In this case, the toner images formed on the first, the second, the third, and the fourth photosensitive bodies 101Y, 101M, 101C and 101K are not directly transferred to the printing paper P, but are first transferred as a first transfer image onto the intermediate transfer unit and then retransferred from the intermediate transfer unit onto the printing paper P.

The operation of assembling and disassembling the first, the second, the third, and the fourth image forming cartridges 110Y, 110M, 110C and 110K of the tandem color image forming device 100 having the shaft fixing unit 200 according to an exemplary embodimnent of the preferred embodiment of the present invention constructed as above is explained with reference to FIGS. 4 through 9B.

First, the operation of disassembling the first, the second, the third, and the fourth image forming cartridges 110Y, 110M, 110C and 110K is explained as follows.

As shown in FIG. 5, to disassemble the first, the second, the third, and the fourth image forming cartridges 110Y, 110M, 110C and 110K in maintenance, repair or replacement, the cover 190 is opened by pivoting in one direction, for example, counterclockwise, about the rotation axle 193.

As a result, as shown in FIGS. 9A and 9B, the link member 260 installed on the upper portion of the cover 190 moves in the direction of arrow C along with the cover 190. Thereby, the projections 254 of the projecting part 253 of the cam gear 250 engaged with the receiving grooves 263 also move in the direction indicated by arrow C.

As the projections 254 move in the direction of arrow C, the cam gear 250 rotates counterclockwise together with the first, the second, the third, and the fourth cams 230Y, 230M, 230C and 230K coaxially formed on the cam shaft 240.

Figure 8:
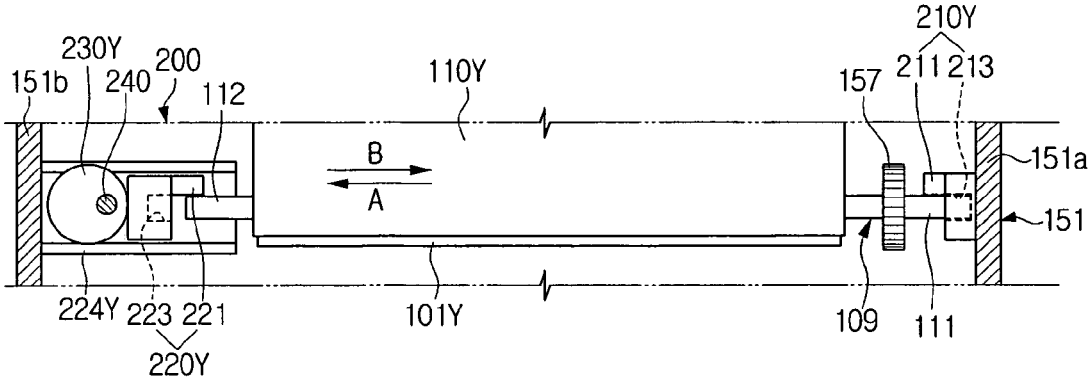
FIG. 8 is a partial top plan view taken along line I-I of FIG. 7.

At this time, the cam gear 250 and the first, the second, the third, and the fourth cams 230Y, 230M, 230C and 230K are rotated by about a half turn by the projections 254 and the receiving grooves 263. As a result, as shown in FIGS. 7 and 8, the first, the second, the third, and the fourth cams 230Y, 230M, 230C and 230K are positioned so that cam surfaces thereof adjacent to the camshaft 240 come in contact with the first, the second, the third, and the fourth movable brackets 220Y, 220M, 220C and 220K. Accordingly, the first, the second, the third, and the fourth movable brackets 220Y, 220M, 220C and 220K are moved in the direction of arrow A by the pulling force of the first, the second, the third, and the fourth extension spring 270Y, 270M, 270C and 270K. Thereby, the second ends 112 of the shafts 109 of the first, the second, the third, and the fourth photosensitive bodies 101Y, 101M, 101C and 101K is slipped out from the rotation supporting holes 223.

Under this state, the first image forming cartridge 110Y is moved in the direction of arrow A by a user, so that the shaft 109 of the first photosensitive body 101Y is positioned in proper position between the first fixed bracket 210Y and the first movable bracket 220Y. At this time, since the first end 111 of the shaft 109 is slipped out from the first rotation supporting hole 213, the first image forming cartridge 110Y is set at free position where the first and the second ends 111 and 112 of the shaft 109 are not fixed in either the first rotation supporting hole 213 or the second rotation supporting hole 223. Then, the first image forming cartridge 110Y is removed from the case 151 of the cartridge frame 108 to the outside.

After that, the second, the third and the fourth image forming cartridges 110M, 110C, and 110 K are removed to outside in the same manner as that of the first image forming cartridge 110Y. As a result, the operation of disassembling the first, the second, the third and the fourth image forming cartridges 110Y, 110M, 110C, and 110 K is completed.

Next, the operation of assembling the first, the second, the third and the fourth image forming cartridges 110Y, 110M, 110C, and 110 K in the case 151 of the cartridge frame 108 after they are removed and repaired or maintained, or when they are replaced with new ones after removed is explained as follows.

First, as shown in FIG. 5, under a state that the cover 190 is opened, the first image forming cartridges 110Y are inserted in the cartridge frame 108, and placed on the supporting plate 181.

Subsequently, the first image forming cartridges 110Y is adjusted so that the shaft 109 of the first photosensitive body 101Y is positioned in the proper position between the first fixed bracket 210Y and the first movable bracket 220Y, and then inserted in the direction of arrow D until movement of the first and the second ends 111 and 112 of the shaft 109 are respectively restrained by the first and the second stoppers 211 and 221. As a result, the driven gear 157 formed in the first end 111 of the shaft 109 is engaged with the idle gear 156.

As shown in FIGS. 7 and 8, the first image forming cartridge 110Y is moved in the direction of arrow B. Thereby, the first end 111 of the shaft 109 of the first photosensitive body 101Y is inserted into the first rotation supporting hole 213.

In the same manner, the second, the third and the fourth image forming cartridges 110M, 110C and 110K are then inserted into the cartridge frame 108 of the main body 178, and moved in the direction of arrow D until movements of the first and the second ends 111 and 112 of the shafts 109 are respectively restrained by the first and the second stoppers 211 and 221, and then moved in the direction of arrow B to allow the first end 111 to be inserted into the first rotation supporting hole 213.

As shown in FIG. 4, the cover 190 is closed by pivoting in the other direction, that is, clockwise, about the rotation axle 193. As a result, as shown in FIGS. 9A and 9B, the link member 260 installed on the upper portion of the cover 190 moves in the direction of arrow D along with the cover 190. Thereby, the projections 254 of the projecting part 253 of the cam gear 250 are engaged with the receiving grooves 263 also move in the direction of arrow D.

As the projections 254 move in the direction of arrow D, the cam gear 250 rotates clockwise together with the first, the second, the third, and the fourth cams 230Y, 230M, 230C and 230K through the camshaft 240.

The cam gear 250 and the first, the second, the third, and the fourth cams 230Y, 230M, 230C and 230K are rotated by about a half turn by the projections 254 and the receiving grooves 263. As a result, as shown in FIG. 6, the first, the second, the third, and the fourth cams 230Y, 230M, 230C and 230K are positioned so that cam surfaces thereof apart from the camshaft 240 come in contact with the first, the second, the third, and the fourth movable brackets 220Y, 220M, 220C and 220K. Accordingly, the first, the second, the third, and the fourth movable brackets 220Y, 220M, 220C and 220K are moved in the direction of arrow B against the pulling force of the first, the second, the third, and the fourth extension springs 270Y, 270M, 270C and 270K. Thereby, the second ends 112 of the shafts 109 of the first, the second, the third, and the fourth photosensitive bodies 101Y, 101M, 101C and 101K are inserted in the rotation supporting holes 223.

Thus, as the second ends 112 of the shafts 109 are inserted in the rotation supporting holes 223, the operation of assembling the first, the second, the third, and the fourth image forming cartridges 110Y, 110M, 1010C and 110K are completed.

As apparent from the forgoing description, the apparatus for fixing shafts of cartridges and the image forming device having the same according to exemplary embodiments of the present invention have the fixed supporting part and the movable supporting part that do not serve to transmit the driving force of the motor to the shafts of the cartridges, such as the shafts of the photoconductor bodies, but serve only to fix the shafts. Therefore, when the image forming cartridges are mounted in the cartridge frame formed in the main body, the shafts of the cartridges may be fixed at the proper position, thereby enabling the image forming device to obtain uniform quality images.

The apparatus for fixing shafts of cartridges and the image forming device having the same according to exemplary embodiments of the present invention have a structure of fixing the shafts of the cartridges, such as shafts of the photosensitive bodies, by using the movable supporting part that is worked with opening and closing operation of the cover. Therefore, the image forming cartridges may be easily assembled and disassembled in the cartridge frame of the main body, thereby enabling the image forming device to be easily fabricated, assembled, maintained, and repaired.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An apparatus for fixing a shaft of a cartridge, comprising:

a fixed supporting part formed at a frame and rotatably supporting a first end of at least one shaft of at least one cartridge;

a movable supporting part formed at the frame to be movable between a first position and a second position and rotatably supporting a second end of the shaft of the at least one cartridge, the movable supporting part including at least one moveable bracket rotatably supporting the second end of the shaft of the cartridge; and a bracket moving guide extending inwardly from the frame within which the at least one moveable bracket moves to guide the movable bracket between the first and second positions; and an operating part operating to move the movable supporting part between the first position and the second position, the operating part being operated in response to opening and closing of a cover of an image forming apparatus in which the cartridge is installed.

2. The apparatus according to claim 1, wherein the fixed supporting part includes at least one fixed bracket having a first rotation supporting hole to rotatably support the first end of the shaft of the cartridge.

3. The apparatus according to claim 2, wherein the fixed bracket includes a first stopper for restraining movement of the first end of the shaft of the cartridge to guide a fixing position of the first end.

4. The apparatus according to claim 1, wherein the at least one movable bracket has a second rotation supporting hole to rotatably support the second end of the shaft of the cartridge.

5. The apparatus according to claim 4, wherein the movable bracket includes a second stopper for restraining movement of the second end of the shaft of the cartridge to guide a fixing position of the second end.

6. The apparatus according to claim 4, wherein the operating part includes a cam member having a cam disposed to be in contact with the movable bracket;

a cam gear formed on a shaft of the cam member; and a rotation actuator to rotate the cam gear.

7. The apparatus according to claim 6, wherein the rotation actuator includes a projecting member having a plurality of projections formed in a spaced-apart relation from each other at an outer circumference of the cam gear; and a link member connected to the cover for opening the inside of the frame to move together with the cover, and having a plurality of receiving grooves formed in the same spaced-apart relation from each other as the projections of the projecting member to be engaged therewith in opening and closing of the cover.

8. The apparatus according to claim 6, wherein the operating part includes a pulling member for elastically pulling the movable bracket to be in contact with the cam.

9. The apparatus according to claim 8, wherein the pulling member includes an elastic spring disposed between the movable bracket and the bracket moving guide.

10. An image forming device, comprising:

a frame;

at least one cartridge removably mounted in the frame, and having at least one shaft; and a shaft fixing unit for fixing the shaft of the cartridge, including a fixed supporting part formed at the frame and rotatably supporting a first end of the shaft of the cartridge;

a movable supporting part formed at the frame to be movable between a first position and a second position, and rotatably supporting a second end of the shaft of the cartridge, the movable supporting part including at least one moveable bracket rotatably supporting the second end of the shaft of the cartridge; and a bracket moving guide extending inwardly from the frame within which the at least one moveable bracket moves to guide the movable bracket between the first and second positions; and an operating part operating to move the movable supporting part between the first position and the second position, the operating part being operated in response to opening and closing of a cover of an image forming apparatus in which the cartridge is installed.

11. The image forming device according to claim 10, wherein the fixed supporting part includes at least one fixed bracket having a first rotation supporting hole to rotatably support the first end of the shaft of the cartridge.

12. The image forming device according to claim 11, wherein the fixing bracket includes a first stopper for restraining movement of the first end of the shaft of the cartridge to guide a fixing position of the first end.

13. The image forming device according to claim 10, wherein the at least one movable bracket has a second rotation supporting hole to rotatably support the second end of the shaft of the cartridge.

14. The image forming device according to claim 13, wherein the movable bracket includes a second stopper for restraining movement of the second end of the shaft of the cartridge to guide a fixing position of the second end.

15. The image forming device according to claim 13, wherein the operating part includes a cam member having a cam disposed to be in contact with the movable bracket;

a cam gear formed on a shaft of the cam member; and a rotation actuator to rotate the cam gear.

16. The image forming device according to claim 15, wherein the rotation actuator includes a projecting member having a plurality of projections formed in a spaced-apart relation from each other at an outer circumference of the cam gear; and a link member connected to the cover for opening the inside of the frame to move together with the cover, and having a plurality of receiving grooves formed in the same spaced-apart relation from each other as the projections of the projecting member to be engaged therewith in opening and closing of the cover.

17. The image forming device according to claim 15, wherein the operating part includes a pulling member for elastically pulling the movable bracket to be in contact with the cam.

18. The image forming device according to claim 17, wherein the pulling member includes an elastic spring disposed between the movable bracket and the bracket moving guide.

19. The apparatus according to claim 1, wherein the shaft of the cartridge is a shaft of a photosensitive body on which a developer image is formed.

20. The image forming device according to claim 10, wherein the shaft of the cartridge is a shaft of a photosensitive body on which a developer image is formed.

* * * * *